US009937979B1

(12) United States Patent
Holmes

(10) Patent No.: US 9,937,979 B1
(45) Date of Patent: Apr. 10, 2018

(54) MANUAL SUBMERSIBLE AUXILIARY SWIM PLATFORM FOR VESSELS

(71) Applicant: Nathan Holmes, Merritt Island, FL (US)

(72) Inventor: Nathan Holmes, Merritt Island, FL (US)

(73) Assignee: BRUNSWICK CORPORATION, Lake Forest, IL (US)

( * ) Notice: Subject to any disclaimer, the term of this patent is extended or adjusted under 35 U.S.C. 154(b) by 0 days.

(21) Appl. No.: 15/261,454

(22) Filed: Sep. 9, 2016

Related U.S. Application Data

(60) Provisional application No. 62/216,790, filed on Sep. 10, 2015.

(51) Int. Cl.

| | |
|---|---|
| ***B63B 17/00*** | (2006.01) |
| ***B63B 29/00*** | (2006.01) |
| ***B63B 29/04*** | (2006.01) |
| ***B63B 3/48*** | (2006.01) |

(52) U.S. Cl.
CPC ..... *B63B 17/00* (2013.01); *B63B 3/48* (2013.01); *B63B 29/00* (2013.01); *B63B 29/04* (2013.01); *B63B 2029/043* (2013.01)

(58) Field of Classification Search
CPC . B63B 2029/022; B63B 27/146; B63B 27/14; B60R 3/02
USPC ..... 114/362
See application file for complete search history.

(56) References Cited

U.S. PATENT DOCUMENTS

| | | | | |
|---|---|---|---|---|
| 2,809,849 | A * | 10/1957 | Benne | B60R 3/02 182/88 |
| 3,627,350 | A * | 12/1971 | Cross | B60R 3/02 182/91 |
| 4,198,070 | A * | 4/1980 | Weiler | B60R 3/02 182/91 |
| 4,462,485 | A * | 7/1984 | Terry | B63B 27/14 114/362 |
| 4,742,795 | A * | 5/1988 | DePrey | B63B 19/08 114/343 |
| 5,085,164 | A * | 2/1992 | Whitton | B63B 27/14 114/362 |
| 5,613,462 | A * | 3/1997 | Schwartz | B63B 23/32 114/362 |
| 6,904,863 | B2 * | 6/2005 | Mardikian | B63B 27/146 114/362 |
| 7,121,226 | B2 * | 10/2006 | Grimaldi | B63B 27/14 114/362 |
| 7,162,969 | B2 * | 1/2007 | Houlder | B63B 27/14 114/362 |

(Continued)

*Primary Examiner* — Lars A Olson
*Assistant Examiner* — Jovon E Hayes
(74) *Attorney, Agent, or Firm* — Malin Haley DiMaggio & Bowen, P.A.

(57) ABSTRACT

A manual and submersible auxiliary swim platform for a vessel having a main aft platform, the main aft platform having a recessed area for receiving the auxiliary swim platform. A pair of bracket assemblies secure the auxiliary platform to the main aft platform, and both bracket assemblies have a first bracket member, a second bracket member, and a detent bushing. The detent bushing is interposed and secured to the first and second bracket members at a common end. The detent bushing limits rotational and pivotal movement of the bracket assemblies in conjunction with a contact tab, pin and channel design of the bracket assemblies.

10 Claims, 8 Drawing Sheets

(56) References Cited

U.S. PATENT DOCUMENTS

| | | | | |
|---|---|---|---|---|
| 7,182,175 | B1 * | 2/2007 | Schmitt | B63B 27/143 114/362 |
| 7,607,400 | B2 * | 10/2009 | Scotti | B63B 29/20 114/362 |
| 7,707,955 | B1 * | 5/2010 | Johns, Jr. | B63B 27/36 114/259 |
| 7,900,575 | B2 * | 3/2011 | Walbridge | B63B 29/04 114/363 |
| 7,946,243 | B1 * | 5/2011 | Ulrich | B63B 27/16 114/362 |
| 8,375,880 | B1 * | 2/2013 | St Clair, Jr. | B63B 27/14 114/362 |
| 8,646,400 | B2 * | 2/2014 | Grimaldi | B63B 27/146 114/362 |
| D710,288 | S * | 8/2014 | Dorton | D12/316 |
| 8,833,290 | B2 * | 9/2014 | Mueller | B63B 27/14 114/343 |
| 9,003,997 | B2 * | 4/2015 | Gratz | B63B 17/00 114/362 |
| 9,016,228 | B2 * | 4/2015 | Dorton | B63B 27/146 114/343 |
| 9,586,655 | B1 * | 3/2017 | Butler | B63B 27/14 |
| 9,592,887 | B2 * | 3/2017 | Frabetti | B63B 27/143 |
| 9,676,467 | B2 * | 6/2017 | Terazawa | B63J 2/06 |
| 2005/0016439 | A1 * | 1/2005 | Mardikian | B63B 27/146 114/362 |
| 2009/0308688 | A1 * | 12/2009 | Tayar | B60R 3/02 182/89 |
| 2011/0023770 | A1 * | 2/2011 | Brown | B63B 27/143 114/362 |

* cited by examiner

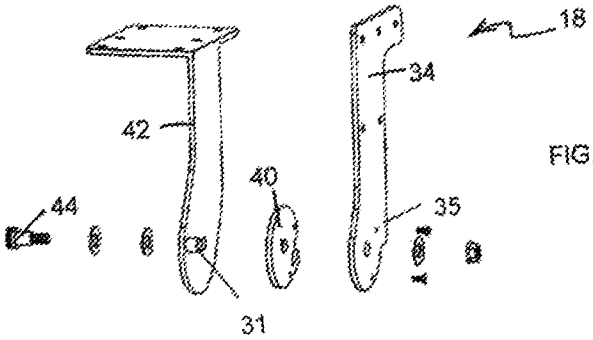
FIG. 9
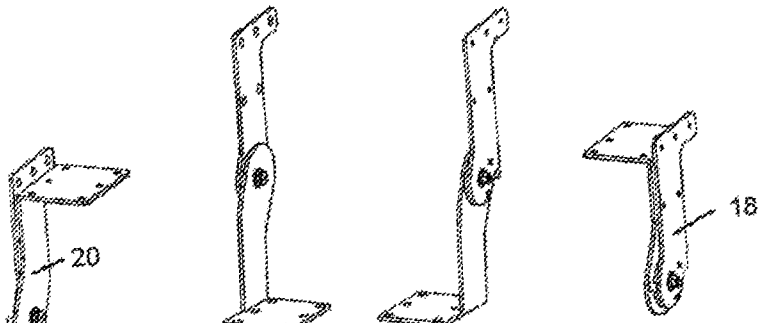
FIG. 7D
FIG. 7C
FIG. 7B
FIG.7A
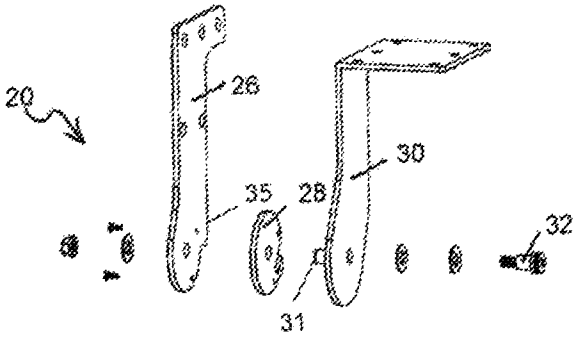
FIG. 8

MANUAL SUBMERSIBLE AUXILIARY SWIM PLATFORM FOR VESSELS

CROSS REFERENCE TO RELATED APPLICATIONS

This utility patent application claims priority and the benefit of U.S. Provisional Application No. 62/216,790 filed on Sep. 10, 2015.

STATEMENT REGARDING FEDERALLY SPONSORED RESEARCH OR DEVELOPMENT

N/A

BACKGROUND OF THE INVENTION

1. Field of the Invention

The present invention generally relates to swim platforms for marine vessels and more specifically to a secondary or auxiliary swim platform which is submersible and integrated within a boat's conventional aft swim platform or rearward deck.

2. Description of Related Art

Traditional recreational marine vessels incorporate various configurations of platforms at the transom (i.e. stern) of the vessel. The platforms serve a variety of functions including providing a mounting point for an outboard engine, providing a platform to standing, sitting, and boarding/deboarding the vessel, and providing a space for sunbathing and lounging. In some cases, the transom platform is not specifically designed for swimming or diving access, but individuals will still use the platform for ingress/egress.

The marine industry has developed several swim platforms which include moveable assemblies have a rigid base, pivotal hinged arms which rotate by actuation devices, retractable steps which attach to the swim platform, telescoping ladders, and a variety of different mechanical components and materials.

There are also a number of secondary hydraulic swim platforms with electro-mechanical control devices which deploy underwater and retract beneath the rear deck or main platform. Others offer a coplanar outward section of the swim platform which can simply be lowered from the main platform.

The prior art provides alternative configurations for swimming/boarding platforms having attached ladders or steps, secondary swim platforms and support structure of varying designs, components and hardware. However, none provide a manual auxiliary swim platform which is integrated into the vessel's platform, is unobtrusive and simple to operate, is submersible, incorporates advanced engineering designs, and enhances recreational boating activities as does the instant invention. Consequently, there is a need for an improved secondary swim platform incorporating these features.

It is, therefore, to the effective resolution of the aforementioned problems and shortcomings of the prior art that the present invention is directed. In view of the vessels having swim platforms in existence at the time of the present invention, it was not obvious to those persons of ordinary skill in the pertinent art as to how the identified needs could be fulfilled in an advantageous manner.

SUMMARY OF THE INVENTION

The present invention concerns a manually operated auxiliary swim platform which attaches to, and is integral within, the conventional aft swim platform or reward deck of a boat. The auxiliary platform is submersible, and provides a unique means of ingress and egress as well as an extension of the entertaining area on the aft section of the vessel. The platform is designed to be stowed or deployed by all users. There are no burdensome or difficult positive latches or locks in the stowed or deployed positions that require separate actions by the user to operate, engage or disengage platform movement. The platform design enhances comfort and securely seats two adults, while being simple and efficient in operation and use by a single person.

The vessels main aft platform is modified to include a recessed area which accepts the auxiliary swim platform, that when stowed rests in the recessed area, is integral and coplanar with the main platform, such as to be unobtrusive and seamless to occupants. It lays flush to the main platform surface so as to not interfere or obstruct the useable surface area.

The auxiliary platform includes a secondary swim platform comprising a deck or step-like seating area, and a pair of oppositely disposed custom designed bracket assemblies on port side and starboard side for mounting and securing the platform to the main swim platform. Each bracket assembly is generally vertical and includes a first bracket member and a second bracket member, along with a unique detent bushing centered between the first and second bracket members, as well as pivot hardware. The first bracket member is secured to the recessed area and acts as a hanger, and the second bracket member is secured to the auxiliary platform and acts as the platform support. The detent bushing is interposed and positioned about the ends of the bracket members along with pivot hardware, and the design of these components control the rotation of the second bracket members about an end of the first, and therefore the movement of the auxiliary platform from both the stowed and deployed positions.

Accordingly, it is an object of the present invention to provide an improved manual auxiliary swim platform for vessels.

It is another object of the present invention to provide an improved manual auxiliary swim platform which is integral with the main aft platform, is unobtrusive and seamless therewith, and is simple in operation while being structurally superior to prior devices.

It is another object of the present invention to provide an improved manual auxiliary swim platform having enhanced design features and components, is cost effective and operationally efficient.

It finally an object of the present invention to provide an improved manual auxiliary swim platform having all the above mentioned features and objects.

In accordance with these and other objects which will become apparent hereinafter, the instant invention will now be described with particular reference to the accompanying drawings.

BRIEF DESCRIPTION OF THE DRAWINGS

FIG. 7A is a perspective view of the port bracket assembly in stowed configuration.

FIG. 7B is a perspective view of the port bracket assembly in deployed configuration.

FIG. 7C is a perspective view of the starboard bracket assembly in deployed configuration.

FIG. 7D is a perspective view of the starboard bracket assembly in stowed configuration.

FIG. 8 is an exploded perspective view of the port bracket assembly.

FIG. 9 is an exploded perspective view of the starboard bracket assembly.

DETAILED DESCRIPTION

Figure 1B:
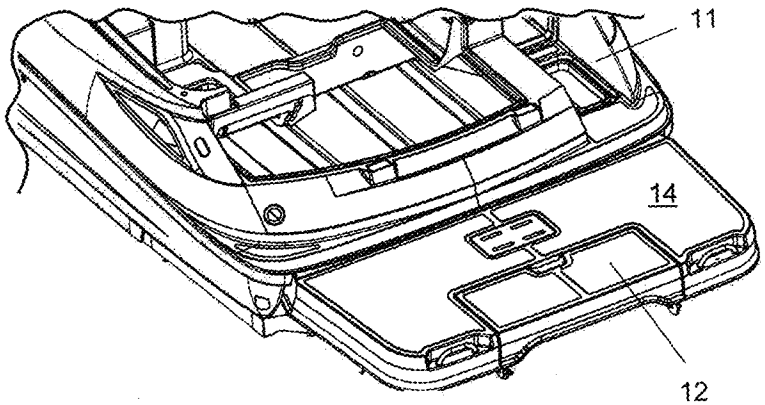
FIG. 1B is a partial perspective view of the rear of an exemplary vessel including the submersible auxiliary swim platform of the present invention.
Figure 1A:
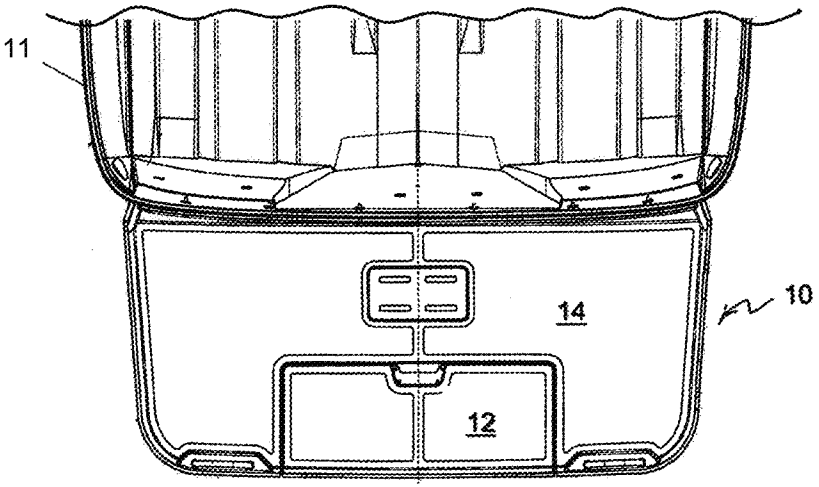
FIG. 1A is a partial top plan view of the rear of an exemplary vessel including the submersible auxiliary swim platform of the present invention.

With reference to FIG. 1A, a top plan view of the instant invention 10 is shown installed on a boat 11, with the manual submersible auxiliary swim platform 12 shown in a stowed position within the vessel's main rear platform 14. FIG. 1B is a perspective view of the invention as shown in FIG. 1A.

Figure 2B:
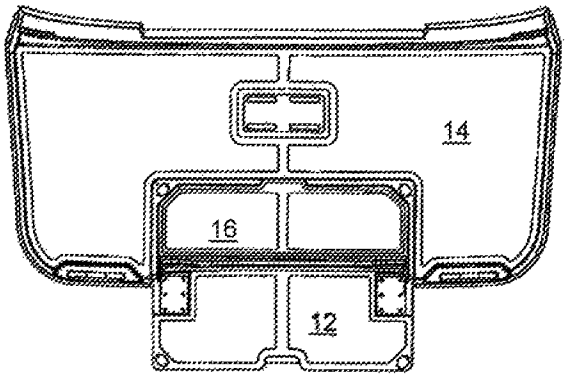
FIG. 2B is a top plan view of the rear of an exemplary vessel including the submersible auxiliary swim platform in the deployed position.
Figure 2A:
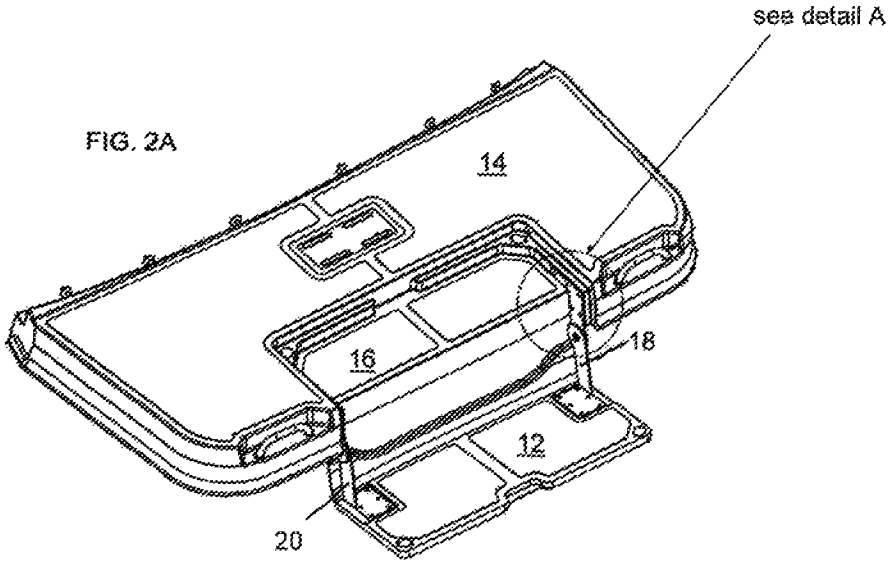
FIG. 2A is a perspective view of the rear of an exemplary vessel including the submersible auxiliary swim platform in the deployed position.

With reference to FIG. 2A, shown is a perspective view of the auxiliary swim platform 12 in a deployed position from the vessel's main rear or swim platform 14. The vessel's main platform includes a recessed area 16 which receives the auxiliary swim platform 12 when in a stowed configuration. Starboard bracket assembly 18 and port bracket assembly 20 are shown in the deployed position, as detailed hereinafter.

Figure 2C:
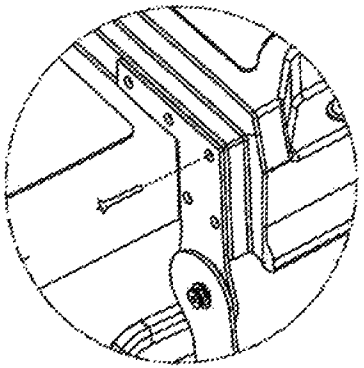
FIG. 2C is an enlarged perspective detail view of the section A of FIG. 2A.

FIG. 2B is a top plan view of the auxiliary swim platform 12 as shown in FIG. 2A. FIG. 2C is a partial perspective view of the bracket assembly 18 detail area A shown in FIG. 2A.

Figure 3:
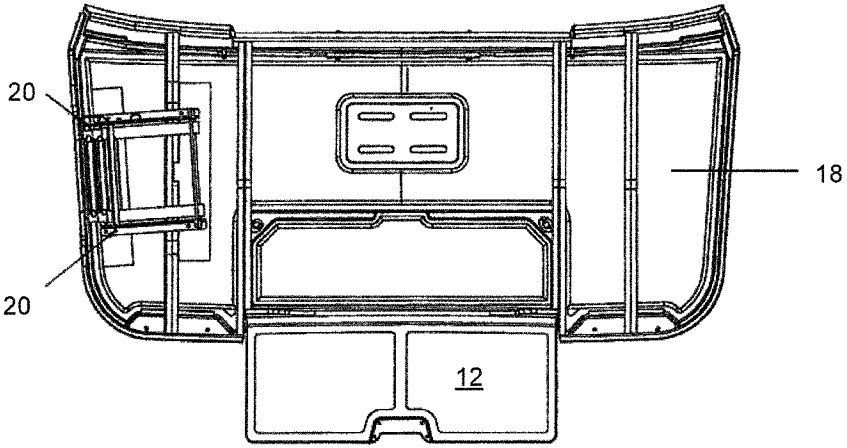
FIG. 3 is a bottom plan view of that shown in FIG. 2B

FIG. 3 is a bottom plan view of the swim platform 12 deployed as shown in FIG. 2B, and the underside 18 of main platform 14, and illustrating a access ladder 20 attached to the underside as well.

Figure 4B:
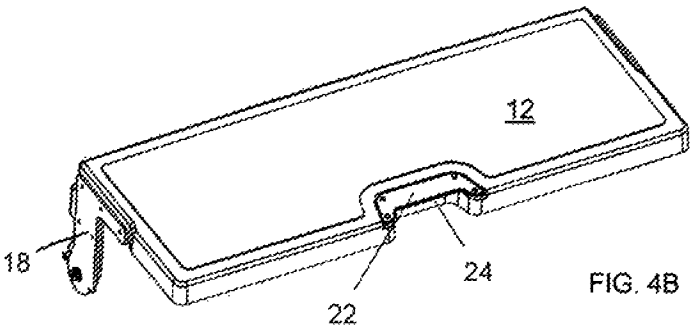
FIG. 4B is an alternative perspective top plan view of the auxiliary swim platform.
Figure 4D:
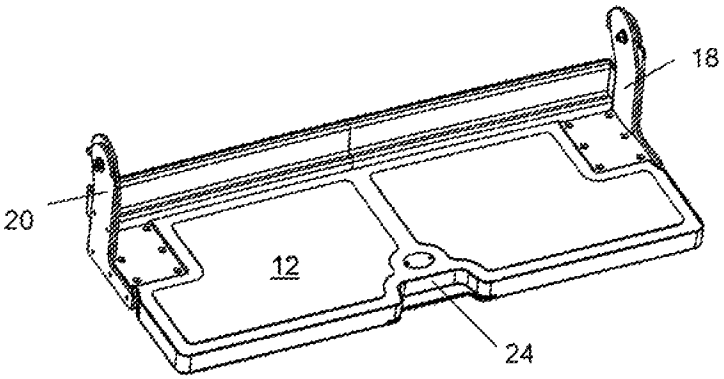
FIG. 4D is a perspective bottom plan view of the auxiliary swim platform shown in FIG. 4C with bracket assemblies attached.
Figure 4A:
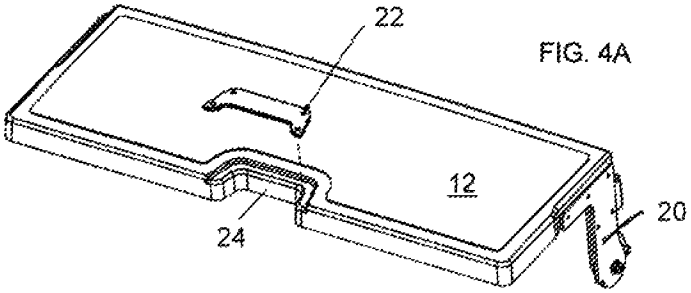
FIG. 4A is a perspective top plan view of the auxiliary swim platform.

FIG. 4A is a perspective top plan view of the auxiliary swim platform 12 and bracket assembly 20 in a stowed configuration, along with handle 22 and cutout 24.

FIG. 4B is an alternative perspective top plan view of the auxiliary swim platform 12 and bracket assembly 18 in a stowed configuration with handle 22 attached and above cutout 24.

Figure 4C:
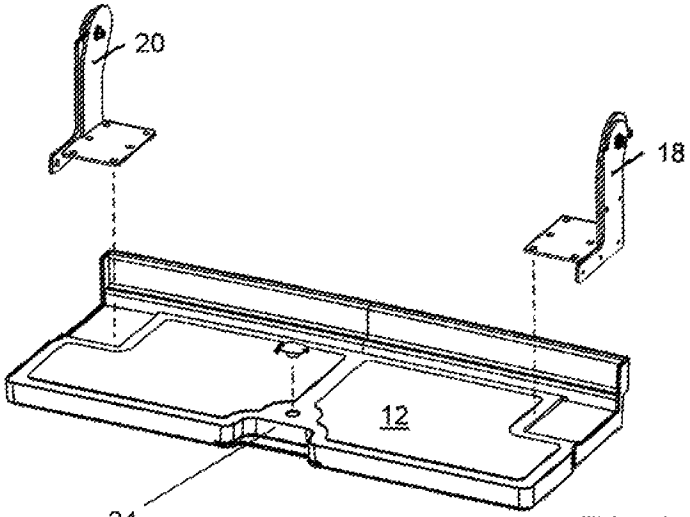
FIG. 4C is a perspective bottom plan view of the auxiliary swim platform shown in FIG. 4A with bracket assemblies in exploded view.

FIG. 4C is a perspective bottom plan view of the auxiliary swim platform 12 as shown in FIG. 4A with bracket assemblies 18 and 20 in exploded detached view.

FIG. 4D is a perspective bottom plan view of the auxiliary swim platform 12 shown in FIG. 4C with bracket assemblies 18 and 20 attached.

Figure 5B:
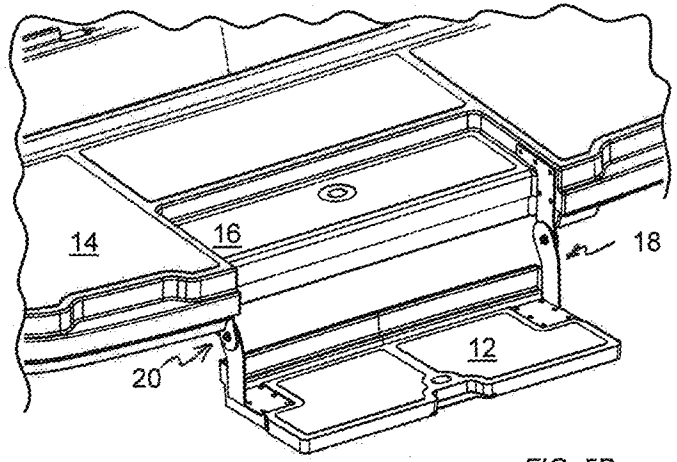
FIG. 5B is an exploded partial assembly perspective view of that shown in FIG. 5A with bracket assemblies attached to vessel's main platform.
Figure 5C:
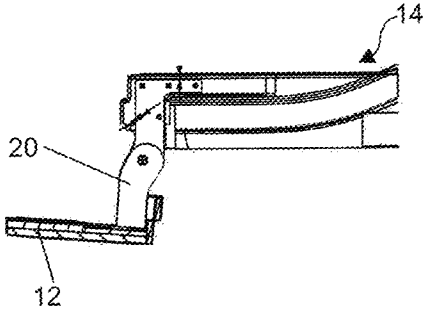
FIG. 5C is a cross-sectional side plan view of that shown in FIG. 5B.
Figure 5A:
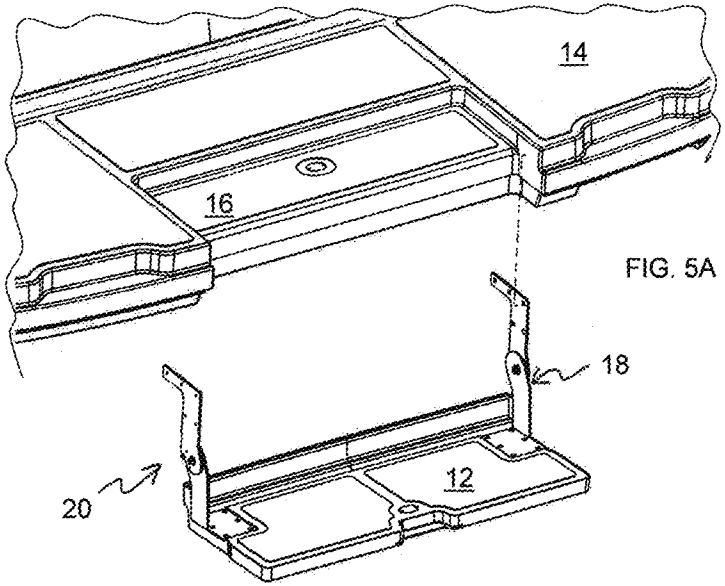
FIG. 5A is an exploded partial assembly perspective view of the auxiliary swim platform with bracket assemblies in deployed position.

FIG. 5A is an exploded partial pre-assembled perspective view of the auxiliary swim platform 12 with bracket assemblies 18 and 20 in deployed position.

FIG. 5B is an exploded partial perspective view of that shown in FIG. 5A with auxiliary platform 12 and bracket assemblies 18 and 20 attached to the vessel's main platform 14, and ready for rotating upwardly and nesting within recessed area 16. It can be seen that auxiliary platform 12 rotates 180 degrees from deployed to stowed positions, and the reverse, through controlled movement by the design of the custom bracket and bushing assemblies.

FIG. 5C is a cross-sectional side plan view of a bracket assembly shown in FIG. 5B, depicting main boat platform 14, bracket assembly 20 and auxiliary platform 12.

Figure 6A:
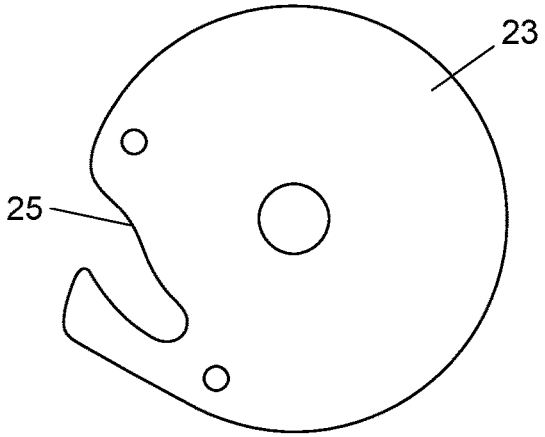
FIG. 6A is a side plan view of the bushing used in the bracket assembly of the instant invention.

FIG. 6A is a side plan view of a bushing 23, which can be a Delrin type, used in the bracket assembly of the instant invention. Bushing 23 is a detent bushing which contains a channel groove area 25 for receiving a bracket pin as described hereinafter.

Figure 6B:
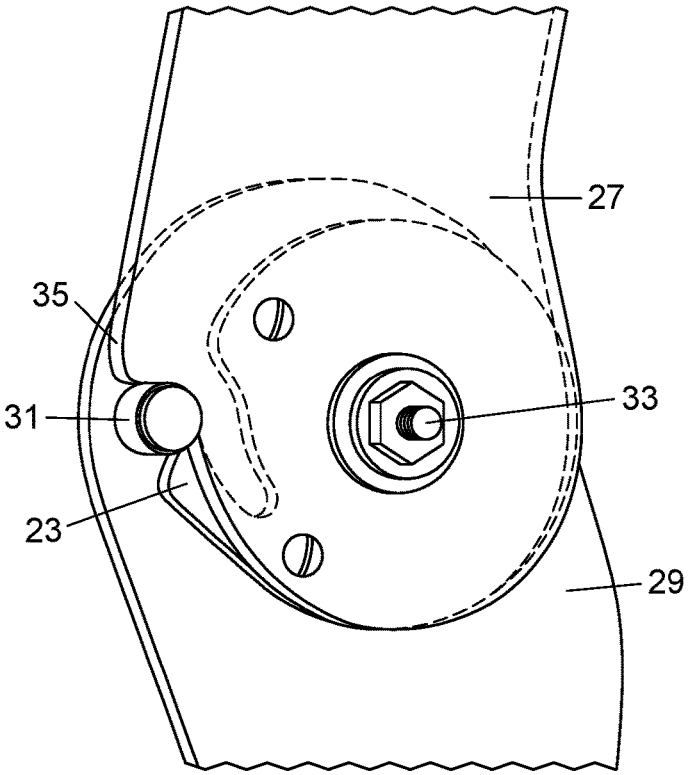
FIG. 6B is a partial perspective side view of the bushing interposed bracket members of the instant invention.

FIG. 6B is a partial perspective side view of the bushing 23 interposed bracket members 27 and 29 in an assembled configuration of the instant invention. Bracket member 29 contains bracket pin 31 which engages detent bushing 23 within the channel groove 25. As the bracket members 27 and 29 rotate around central axis 33, the bracket pin 31 travels within channel groove 25 and is constrained therein. Bracket member 27 also is designed to include a contact tab or edge 35 which provides a stop limiter against opposing bracket member pin 31. It can be seen that bracket pin 31 is offset on bracket member 29 away from the central axis 33, which provides the hardware for the bracket assembly as referenced below. The instant design of the detent bushing, channel groove, bracket members and offset pin provide the unique rotational hinge assembly which defines the movement of the auxiliary platform 12.

FIG. 7A is a perspective view of the port bracket assembly 20 in stowed configuration.

FIG. 7B is a perspective view of the port bracket assembly 20 in deployed configuration.

FIG. 7C is a perspective view of the starboard bracket assembly 18 in deployed configuration.

FIG. 7D is a perspective view of the starboard bracket assembly 18 in stowed configuration.

FIG. 8 is an exploded perspective view of the port bracket assembly 20 components prior to complete assembly. This includes first port bracket member 26, detent bushing 28, second port bracket member 30, support bolt 32 and associated assembly hardware, central bolt, washers and nut as shown. Second bracket member 30 contains the bracket offset pin 31 which engages the bushing channel groove as described above. First bracket member 26 is designed with the contact tab or stop limiter edge 35 which also can engage bracket offset pin 31 as referenced.

FIG. 9 is an exploded perspective view of the starboard bracket assembly 18 prior to complete assembly. This depicts corresponding and complementary bracket assembly features and components as described in FIG. 8, including first port bracket member 34, detent bushing 40, second port bracket member 42, central support bolt 44 and associated hardware as shown. Second bracket member 42 contains the bracket offset pin 31 which engages the bushing channel groove as described above. First bracket member 34 is also designed with the stop limiter edge 35 which also can engage bracket offset pin 31 as referenced.

The first bracket members act as hangers from the main vessel platform, and the second bracket members as support and securing means for the auxiliary swim platform.

As illustrated and describe above, the bracket assemblies are mechanisms consisting of two flat stainless steel plates that are rigid, two stainless brackets that carry the platform, and two large flat center bushings as well as pivot hardware. The rigid plates are mounted to the main vessel deck on the inside walls of the platform recess areas. The two movable stainless steel brackets pivot relative to the rigid plates having 90 degree flanges for mounting the platform. These movable plates are designed with a welded pin that is designed to contact a tab on the rigid plates to provide a secure stop in the deployed position. The large center bushing can be made from Delrin and is designed with a precision cut or channel feature that engages the pin on the movable plates to provide a reliable detent that holds the platform in the deployed position while still allowing the user to easily retrieve it. This center bushing is preassembled to the rigid plates to tightly control the quality of the detent action. The rigid plates, detent bushing, and moving brackets are assembled with stainless shoulder bolts, Nylon and stainless steel flat washers and a Nylon lock nut. The platform in a particular embodiment is a close molded fiberglass part with foam core and aluminum plates in the bracket mounting area to prevent having visible hardware on the top surfaced when stowed.

FIGS. 6A and 6B depict the detent bushing, pin, moveable bracket plates and interrelationship thereto.

The second bracket member of each bracket assembly rotates about the central axis downwardly from the first bracket member from a stowed to a deployed position as illustrated in the Figures. The detent bushing interposed the opposing bracket members controls and limits the movement of the auxiliary platform through the interrelated designs of the bushing, bracket members, offset pin, and engagement components as described. The bushing and bracket members in a preferred embodiment have generally circular lower ends which correspond to, and complement, a generally circular shape of the detent bushing.

Figure 10B:
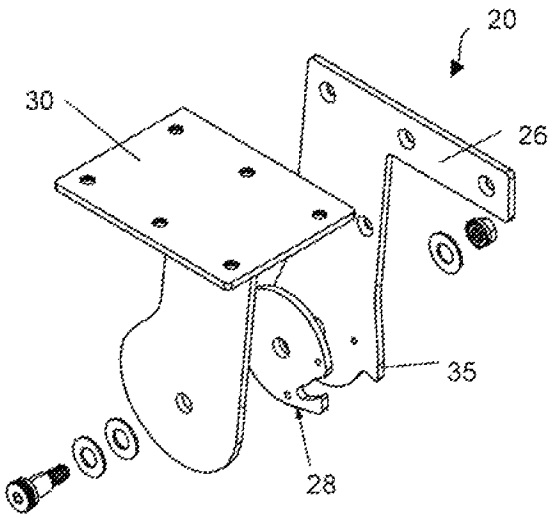
FIG. 10B is an alternative exploded perspective view of the port side bracket assembly.
Figure 10A:
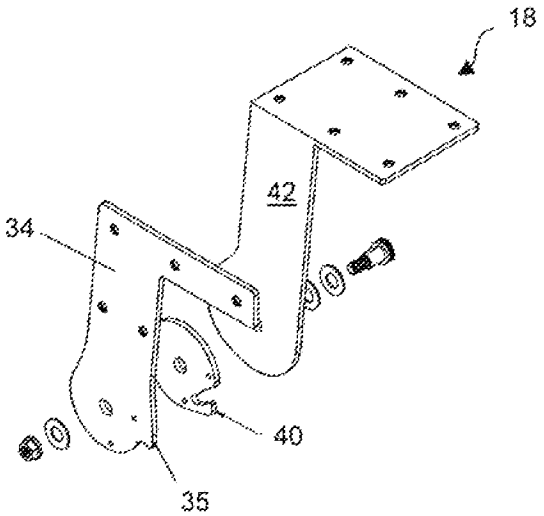
FIG. 10A is an alternative exploded perspective view of the starboard side bracket assembly.

FIG. 10A is an alternative exploded perspective view of the starboard side bracket assembly 18.

FIG. 10B is an alternative exploded perspective view of the port side bracket assembly 20.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A manual and submersible auxiliary swim platform for a vessel having a main aft platform, comprising:

said main aft platform having a recessed area for receiving said auxiliary swim platform;

a pair of bracket assemblies for securing said auxiliary platform to said main aft platform;

each said bracket assembly including a first bracket member, a second bracket member, and a detent bushing;

said detent bushing interposed said first and second bracket members and secured therein;

said detent bushing limiting movement of said second bracket member;

said first bracket member for being secured to said main aft platform within said recessed area;

said second bracket member secured to said auxiliary swim platform; and said bracket assemblies providing for movement of said auxiliary swim platform from a stowed position to a deployed position.

2. The apparatus of claim 1, further comprising:

said first bracket member having a first end and a second end, said first end for securing to said main aft platform;

said second bracket member having a first end and a second end, said first end for securing to auxiliary swim platform; and said second ends of said first and second bracket members being rotatably secured to one another, said detent bushing being interposed therein.

3. The apparatus of claim 2, further comprising:

said second ends of said first and second bracket members, and said detent bushing, being of complementary geometric shape; and said bracket assemblies being generally vertically disposed.

4. The apparatus of claim 3, further comprising:

said second end of said second bracket member having an off-set pin;

said detent bushing having a defined channel;

said second end of said first bracket member having a contact tab;

said off-set pin pivotally engaging said defined channel and said contact tab upon rotation of said bracket assembly.

5. The apparatus of claim 4, further comprising:

said second ends of said first and second bracket members, and said detent bushing, having a generally circular shape.

6. The apparatus of claim 5, further comprising:

said first end of said second bracket member having an angled flange member, said flange member for securing said auxiliary swim platform to said second bracket member.

7. A submersible auxiliary platform for a vessel having a main platform, comprising:

said main platform having a recessed area for receiving said auxiliary platform;

a pair of opposing, complementary and generally vertical bracket assemblies for securing said auxiliary platform to said main platform;

each said bracket assembly including a first bracket member, a second bracket member, and a detent bushing;

said detent bushing interposed said first and second bracket members and secured therein;

said detent bushing limiting movement of said second bracket member;

said first bracket member for being secured to said main platform within said recessed area;

said second bracket member secured to said auxiliary platform; and said bracket assemblies providing for movement of said auxiliary platform from a stowed position to a deployed position.

8. The apparatus of claim 7, further comprising:

said first and second bracket members being rotatably secured to one another at a common end; and said detent bushing being interposed therein.

9. The apparatus of claim 8, further comprising:

said second bracket member having an angled flange member at one end, said flange member for securing said auxiliary platform to said second bracket member.

10. The apparatus of claim 9, further comprising:

said second bracket member having an off-set pin;

said detent bushing having a defined channel;

said first bracket member having a contact tab;

said off-set pin pivotally engaging said defined channel and said contact tab upon rotation of said bracket assembly.

* * * * *